United States Patent [19]

McMurray

[11] 4,089,776

[45] May 16, 1978

[54] PROCESS FOR THE SEPARATION OF AGGLOMERATED CARBONACEOUS PARTICLES FROM ASSOCIATED INORGANIC MATERIALS

[76] Inventor: Russell L. McMurray, R.R. 2, Box 213, Duquoin, Ill. 62832

[21] Appl. No.: 650,886

[22] Filed: Jan. 21, 1976

[51] Int. Cl.[2] ..... B03D 3/06

[52] U.S. Cl. ..... 209/5; 209/49

[58] Field of Search ..... 209/5, 49, 4, 168, 17, 209/171, 458, 459, 460, 463, 464; 210/21, 44, 523

[56] References Cited

U.S. PATENT DOCUMENTS

| | | | |
|---|---|---|---|
| 1,420,163 | 6/1922 | Trent | 209/49 X |
| 1,420,164 | 6/1922 | Trent | 209/49 |
| 1,585,755 | 8/1926 | Borcherdt | 209/49 |
| 2,777,580 | 1/1957 | Hardinge | 209/463 X |
| 3,148,140 | 9/1964 | Kaiser | 210/21 |
| 3,230,282 | 1/1966 | Van Lookenen | 209/5 X |
| 3,278,022 | 10/1966 | Moeschler | 209/17 X |
| 3,279,597 | 10/1966 | Reinhall | 209/17 |
| 3,339,730 | 9/1967 | Boutin | 209/168 X |
| 3,464,634 | 9/1969 | Brociner | 209/5 X |
| 3,856,668 | 12/1974 | Shubert | 209/5 X |

*Primary Examiner*—Robert Halper

*Attorney, Agent, or Firm*—Woodard, Weikart, Emhardt & Naughton

[57] ABSTRACT

A separation process is disclosed herein for selectively removing agglomerated carbonaceous particles from aqueous suspension, the remaining inorganic particles being removed as a waste product. A source product containing finely divided carbonaceous particles and associated inorganic particles is treated by known techniques to cause the carbonaceous particles to agglomerate. The resultant mixture of such processes contains water, a liquid hydrocarbon, inorganic particles and the agglomerated carbonaceous particles. This resultant mixture is fed continuously into the vertical center of a mixing tank. The mixture is there agitated by an impeller which rotates in the horizontal plane. The agglomerated carbonaceous particles rise to the top of the mixture and are recovered as an overflow stream, the particles thereafter being rinsed with water and dried to produce the desired product. The heavier inorganic particles settle to the funnel-shaped bottom of the tank, and enter the inlet of an auger. The auger carries the suspended inorganic particles to an outlet which is located above the top of the mixture in the tank. The inorganic particles are thereby removed with a minimum amount of water, and they are disposed of in an appropriate manner.

2 Claims, 2 Drawing Figures

PROCESS FOR THE SEPARATION OF AGGLOMERATED CARBONACEOUS PARTICLES FROM ASSOCIATED INORGANIC MATERIALS

BACKGROUND OF THE INVENTION

1. Field of the Invention

This invention relates to the field of removing ash-forming, inorganic particles from carbonaceous particles. More precisely, this invention relates to processes for the separation of aqueous suspensions of agglomerated carbonaceous particles and associated inorganic material.

2. Description of the Prior Art

The method of separating carbonaceous particles from associated, ash-forming inorganic materials is known in the art. These procedures have been devised for treating mixtures which would otherwise be unsuitable for use. Dry and liquid combinations of carbonaceous particles and inorganic materials are produced by many standard mining procedures, and there is therefore readily available mixtures to which these processes are applicable.

The steps for causing the agglomeration of the carbonaceous particles are similar for many of the existing methods. A typical agglomeration procedure is disclosed in U.S. Pat. No. 3,856,668 issued to Shubert on Dec. 24, 1974. The disclosed procedure is used to clarify coal washery waste waters in a two-step process. The coal particles are first agglomerated by the intense mixing of a heavy hydrocarbon, preferably as a water emulsion, with the washery waste water. The mixture then contains water, inorganic particles, the heavy hydrocarbon and the agglomerated coal particles. These four constituents are generally found in all of the existing agglomeration techniques.

The carbonaceous particles are recovered from this mixture in a variety of ways. The separation techniques rely upon two properties of the agglomerated carbonaceous particles. First, the agglomerated particles form relatively large clumps or flocs which may be removed by passing the entire mixture through a fine screen. The agglomerated carbonaceous particles are retained as a cake on the screen and the water and suspended inorganic particles pass through. The second characteristic relied upon is the apparent specific gravity of the flocs. The flocs display an apparent specific gravity of less than 1, and therefore will float to the top of the water suspension. Conversely, the inorganic materials have a specific gravity of greater than 1 and will gradually settle to the bottom of the tank in which the water suspension is contained. Methods based upon these characteristics are disclosed in the Shubert patent previously cited. In U.S. Pat. No. 3,637,464, issued to Walsh et al. on Jan. 25, 1972, there is disclosed a similar agglomeration technique which utilizes a screen to separate the larger agglomerated particles from the water and the inorganic particles. Centrifuges have also been utilized for separating these materials as is disclosed in U.S. Pat. No. 2,769,537 issued to Reerink et al. on Nov. 6, 1956.

SUMMARY OF THE INVENTION

In a process for separating finely divided carbonaceous particles from a mixture which also contains particulate inorganic materials associated with the carbonaceous particles, the process including the agglomeration of the carbonaceous particles by adding a liquid hydrocarbon to an aqueous dispersion of the mixture and by agitating the resultant mixture in a first tank, an improvement is disclosed herein which comprises continuously feeding the agitated resultant mixture from the first tank into a second tank, the resultant mixture being agitated in the second tank while the inorganic materials are removed from the bottom of the second tank and while the agglomerated carbonaceous particles are removed from the top of the second tank.

It is an object of the present invention to provide an improved method for removing agglomerated carbonaceous particles from water suspension.

A further object of the present invention is to provide a procedure which simultaneously removes the inorganic materials and the agglomerated carbonaceous particles from water suspension.

Another object of the present invention is to provide a method for removing inorganic materials from a water suspension which also contains agglomerated carbonaceous particles, a minimum amount of water being removed with the inorganic materials.

It is a further object of the present invention to provide a method for removing agglomerated carbonaceous particles in a continuous operation.

Other objects and advantages of the present invention will become apparent from the figures and description which follow.

DESCRIPTION OF THE PREFERRED EMBODIMENT

Figure 1:
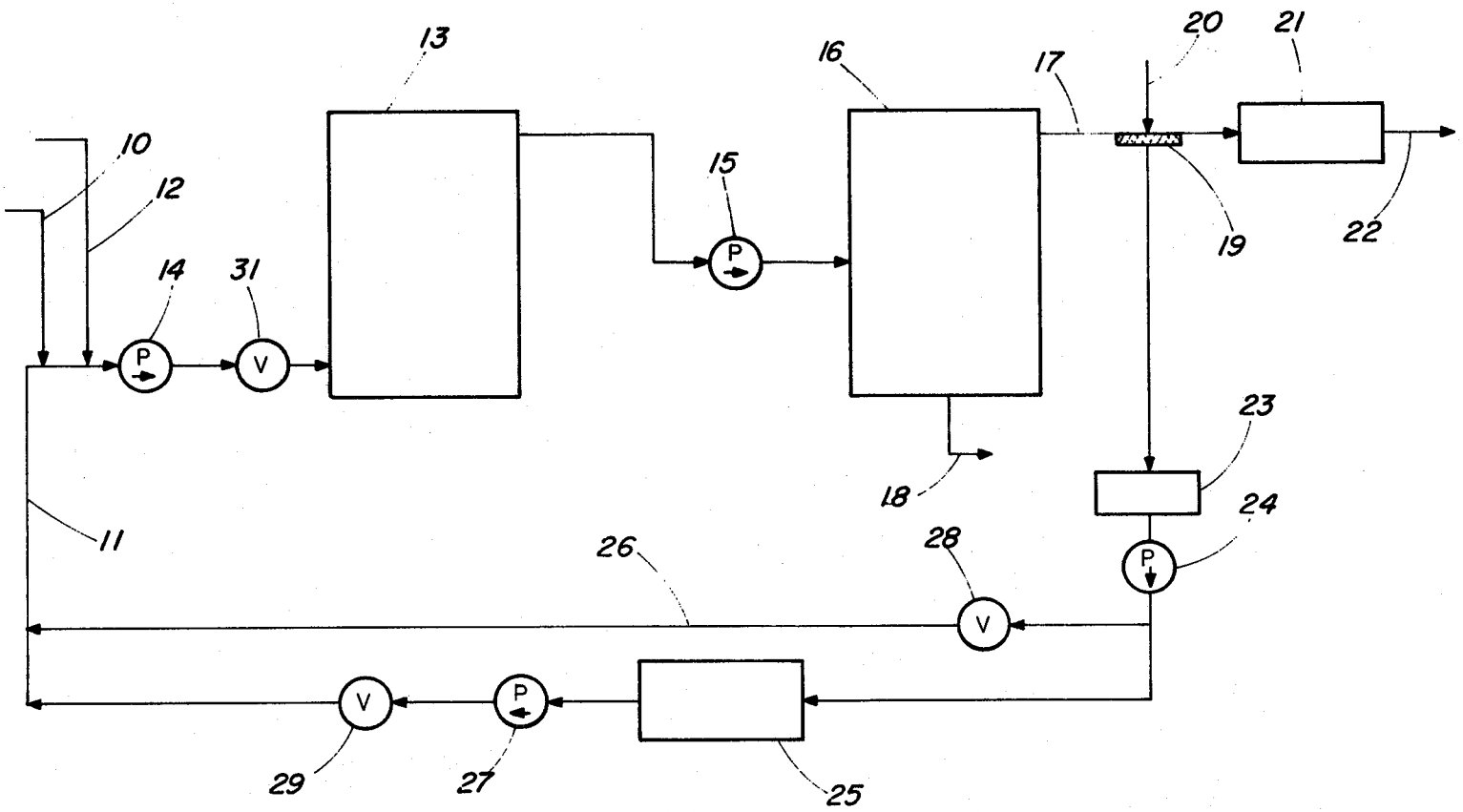
FIG. 1 is a flow diagram of a system for separating carbonaceous particles from waste material, the system incorporating the process of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The general principles relating to the agglomeration of carbonaceous particles are well known. The present invention provides an improved method for separating the constituents of the liquid suspension which contains the agglomerated carbonaceous particles and related inorganic materials. This separation procedure is not dependent on the manner in which agglomeration is effectuated, and therefore is equally applicable to the product of any agglomeration technique.

The desired result is the removal of water and ash-forming constituents from particulate carbonaceous material. The terms "carbonaceous" and "carbonaceous material" are used to define those materials which contain elemental or compounded carbon. Coal fines, for example, are finely divided coal particles which are normally produced in the course of mechanical mining operations. Another example is "black water," which is the term given to the waste water streams produced by wet cleaning methods such as jigs, concentrating tables, classifiers, and launders. In these carbonaceous mixtures, there are generally found particulate inorganic material such as clay, shale, pyrite and other ash-forming materials. Because these materials form ash, their combination with coal makes the coal inferior and less desirable.

The general steps which will result in agglomeration are incorporated into each of the existing procedures. The carbonaceous material is dispersed in aqueous phase and a liquid hydrocarbon is added. The hydrocarbon operates as a bridging agent for the carbonaceous particles and tends to bond them together. The hydrocarbon forms a film on the surface of the carbonaceous particles, replacing the water which originally coated the surface. Contact between oil-coated particles results in a mechanical bonding of the particles. The inorganic materials, however, are not similarly coated by the hydrocarbon and therefore remain as separately suspended particles.

The mixture is agitated with sufficient intensity to cause substantial coating of the carbonaceous materials by the hydrocarbon. The agitation also increases the number of collisions which occur between oil-coated carbonaceous particles. As a result of these collisions, the carbonaceous particles are amalgamated to form relatively large flocs or clumps. These flocs contain carbonaceous material and the hydrocarbon to the exclusion generally of water and the inorganic materials. In addition, the flocs display an apparent specific gravity of less than one and therefore will float to the surface. The heavier ash-forming materials will sink to the bottom.

Referring now to FIG. 1, the standard steps of an agglomeration procedure utilizing the present invention are shown in diagramatic form. The carbonaceous mixture 10 is combined with the water feed 11. The hydrocarbon bridging liquid 12 is also introduced into this stream. The mixture is forced through valve 31 and into the first tank 13 by pump 14. The amount of hydrocarbon used will depend on many factors including the type of hydrocarbon used, the amount of water and carbonaceous particles present, and the temperature of the resultant mixture.

The combination of these three constituents may be accomplished in several ways. The preferred method is to feed the water and hydrocarbon, each heated to about 80° C, and the carbonaceous mixture into the hopper of a progressing cavity pump. The pump then forces the resultant mixture through valve 31 into the bottom of first tank 13. Alternatively, the combination may be effectuated, for example, by suspending the carbonaceous mixture in water and then introducing the hydrocarbon. In either instance, heating of the water and hydrocarbon is advantageous in that it results in a lower-viscosity resultant mixture, and thereby facilitates agglomeration of the carbonaceous particles.

The resultant mixture is agitated within tank 13. The agitation must be performed with substantial intensity to intimately mix the resultant mixture and to produce sufficient collisions between the coated carbonaceous particles to effectuate agglomeration. This agitation generally involves high-shear mixing and preferably includes an impeller which forces the resultant mixture against and around baffles or through small openings.

The resultant mixture is then continually fed by pump 15 into second tank 16. The resultant mixture is agitated within tank 16, although high-shear mixing is not required. In tank 16 the agglomerated carbonaceous particles rise to the top of the resultant mixture and overflow through an outlet 17. The ash-forming inorganic waste materials settle to the bottom and are removed as an outlet stream 18. The carbonaceous particles are conveyed over a screen 19 which has a mesh size substantially larger than the grain size of the majority of the inorganic particles. The carbonaceous clumps are there rinsed with fresh water 20. The carbonaceous material is then dried in oven 21 and the final product 22 is collected.

The water from the overflow stream 17 and from the fresh water rinse 20 is collected and passed through filter system 23. The water is then forced by pump 24 to the water supply reserve 25 or directly back as by-pass stream 26 to the agglomeration tanks. The bypass stream 26 is supplemented as required by water from water reserve 25, which is delivered by pump 27. Control of the relative volumetric flows of the bypass stream 26 and the water from water supply 25 is accomplished by valves 28 and 29, respectively.

Figure 2:
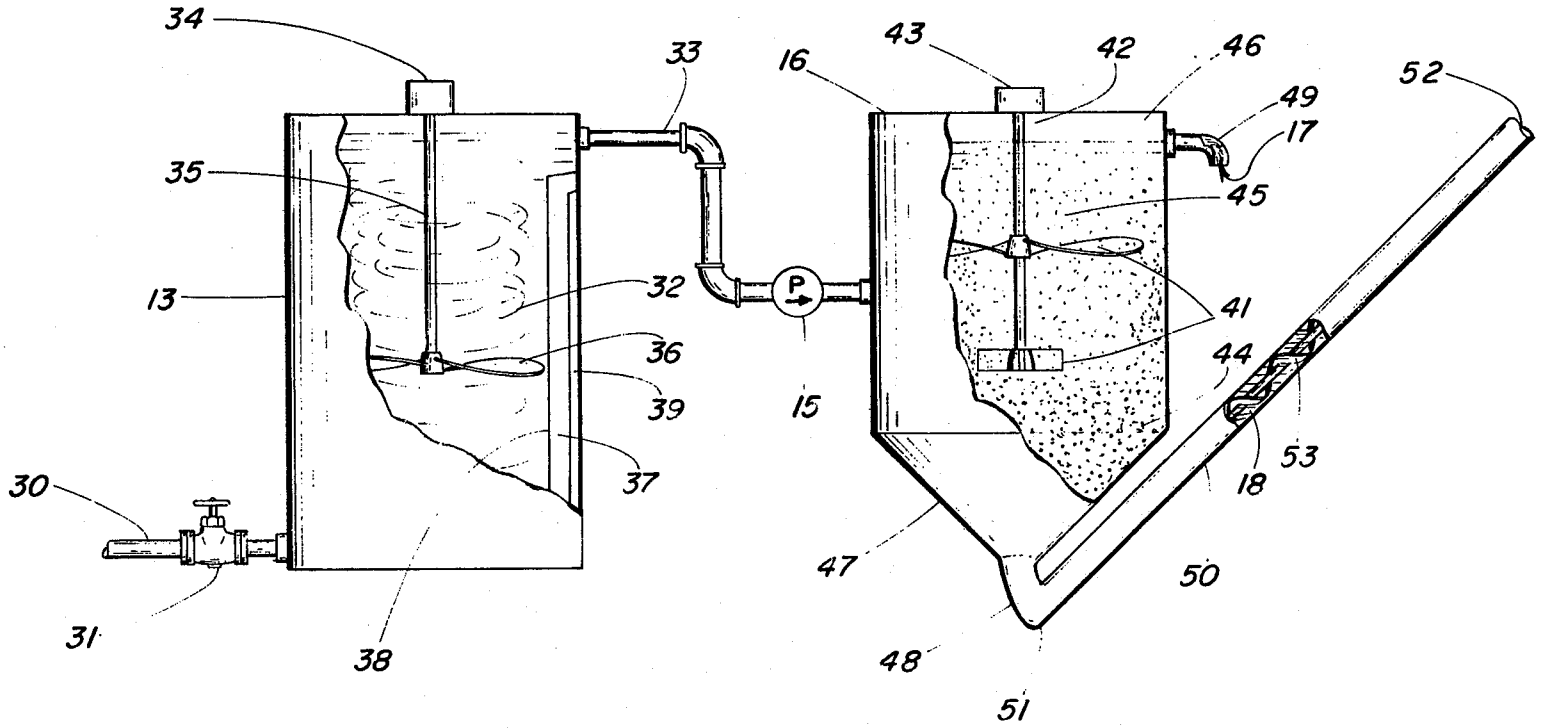
FIG. 2 is a diagrammatic view of the agglomeration and separation tanks of FIG. 1.

A generally diagramatic representation of the agglomeration equipment is shown in FIG. 2. The water, carbonaceous mixture and liquid hydrocarbon are mixed in the hopper of a progressing cavity pump, as previously described. The pump forces the resultant mixture through feed line 30 and valve 31 into the bottom of first tank 13. By feeding into the bottom, the agitated resultant mixture 32 can be removed as an overflow stream through outlet pipe 33. This eliminates the need to valve the outlet stream, and yet assures that the resultant mixture 32 will pass the full height of the first tank 13 before exiting.

The resultant mixture is thoroughly agitated within first tank 13. Motor 34 rotates shaft 35 and the attached impeller blade 36. Vertical baffles such as 37 are attached to the interior wall of first tank 13. The baffle 37 extends toward the center of first tank 13 and has an innermost edge 38 which lies near the ends of the rotated impeller blade 36. The baffle 37 defines a vertical slot 39 along the interior of first tank 13. The rotation of impeller blade 36 forces the resultant mixture 32 against the baffle 37 and through the slot 39. This imparts high-shear forces upon the constituents of the resultant mixture 32, and promotes coating of the carbonaceous particles and their subsequent agglomeration. The exact design of the agitation system may of course be varied, the primary requirement being the production of high-shear mixing.

The agitated resultant mixture is continuously fed by pump 15 from outlet pipe 33 and into the second tank 16. The resultant mixture is agitated by rotating impeller blade 41, which is attached to shaft 42 and driven by motor 43. The agitation need not achieve high-shear mixing, and is intended to promote the vertical segregation of the constituents of the resultant mixture. The impeller operates to force to the outside the heavier inorganic particles 44 which are dispensed in the water. These inorganic particles thereafter settle to the bottom of second tank 16. The lighter, carbonaceous particles 45 concentrate in the center of second tank 16. The agglomerated carbonaceous particles display an apparent specific gravity of less and 1, and therefore rise toward the top 46 of the water. A water dispersion of primarily agglomerated carbonaceous particles is removed through outlet pipe 49 for further treatment.

The resultant mixture is fed into second tank 16 at about the vertical center of the liquid within second tank 16 to facilitate the vertical segregation of the constituents. The agitation is produced in a horizontal plane to further promote segregation of the constituents of the resultant mixture.

The bottom 47 of second tank 16 is generally funnel shaped. This facilitates the settling of the inorganic particles to outlet 48. In addition, the top portion of the funneled surface is impacted by many of the heavier particles. These heavier particles generally consist of the inorganic particles but may also include agglomerated carbonaceous particles in which inorganic particles are trapped. The impact of the latter particles with the narrowing wall 47 of second tank 16 results in the release of the entrapped inorganic particles. The lighter carbonaceous particles are then free to rise within the water.

The dispersed inorganic particles are removed through outlet 48 by auger 50. Auger 50 has an inlet 51 connected to outlet 48 of second tank 16, and an outlet 52 positioned above the top 46 of the liquid in tank 16. The inorganic particles are carried to the outlet 52 by a rotating auger screw 53. By positioning the outlet 52 above the liquid top 46, the inorganic material is removed with a minimum amount of water. The inorganic material transported through outlet 52 is collected and disposed of in a suitable manner.

The present invention thus permits the agglomerated particles to be efficiently and quickly separated from the associated waste materials. A particular advantage of the present system is the use of a continuous rather than batch operation. The parameters of the system may be adjusted to permit the entire process described with respect to FIG. 1 to be performed as a continuous operation.

What is claimed is:

1. In a process for separating finely divided carbonaceous particles from a mixture which also contains particulate inorganic materials associated with the carbonaceous particles, the process including the agglomeration of the carbonaceous particles by adding a liquid hydrocarbon to an aqueous dispersion of the mixture and by agitating the resultant mixture in a first tank, the improvement which comprises:

a. continuously feeding the agitated resultant mixture from said first tank into a second tank containing liquid, the resultant mixture being fed into the second tank at approximately the vertical middle of the liquid contained within said second tank;

b. agitating the resultant mixture in said second tank;

c. removing the inorganic materials from the bottom of said second tank, the bottom of said second tank being generally funnel shaped, the organic materials being removed through an auger, the auger having an inlet connected to the bottom of said second tank and an outlet positioned above the level of the resultant mixture within said second tank; and d. removing the agglomerated carbonaceous particles from the top of said second tank, steps (b), (c) and (d) being performed simultaneously.

2. The improvement of claim 1 in which the resultant mixture is agitated within said tank by an impeller rotating in a horizontal plane.

* * * * *